US005818472A

United States Patent [19]

Usui et al.

[11] Patent Number: 5,818,472

[45] Date of Patent: Oct. 6, 1998

[54] INK JET RECORDING APPARATUS

[75] Inventors: Toshiki Usui; Takahiro Katakura; Tomoaki Abe, all of Nagano, Japan

[73] Assignee: Seiko Epson Corporation, Tokyo, Japan

[21] Appl. No.: 496,974

[22] Filed: Jun. 30, 1995

[30] Foreign Application Priority Data

| | | | |
|---|---|---|---|
| Jul. 1, 1994 | [JP] | Japan | 6-173583 |
| Mar. 8, 1995 | [JP] | Japan | 7-077224 |
| May 31, 1995 | [JP] | Japan | 7-156959 |

[51] Int. Cl.[6] ..... B41J 29/38; B41J 2/045

[52] U.S. Cl. ..... 347/10; 347/70

[58] Field of Search ..... 347/11, 9, 10, 347/68, 70

[56] References Cited

U.S. PATENT DOCUMENTS

| | | | |
|---|---|---|---|
| 5,204,695 | 4/1993 | Ishii | 346/1.1 |
| 5,510,816 | 4/1996 | Hosono et al. | 347/10 |
| 5,521,619 | 5/1996 | Suzuki et al. | 347/10 |
| 5,552,809 | 9/1996 | Hosono et al. | 347/10 |
| 5,563,634 | 10/1996 | Fujii et al. | 347/9 |
| 5,576,743 | 11/1996 | Momose et al. | 347/11 |

FOREIGN PATENT DOCUMENTS

| | | | |
|---|---|---|---|
| 0 580 154 | 1/1994 | European Pat. Off. | B41J 2/045 |
| 0 584 823 | 3/1994 | European Pat. Off. | B41J 2/16 |
| 0 616 891 | 9/1994 | European Pat. Off. | B41J 2/045 |
| 62-288049 | 12/1987 | Japan | B41J 3/04 |

OTHER PUBLICATIONS

Patent Abstracts of Japan vol. 14, No. 478 (M–1036), Oct. 18, 1990, & JP–A–02 192947 (M. Hirozo), Jul. 30, 1990, *abstract*.

Patent Abstracts of Japan vol. 18, No. 173 (M–1581), Mar. 24, 1994 & JP–A–05 338164 (N. Tomoaki), Dec. 21, 1993, *abstract*.

*Primary Examiner*—Safet Metjahic
*Assistant Examiner*—John Chizmar
*Attorney, Agent, or Firm*—Sughrue, Mion, Zinn, Macpeak & Seas, PLLC

[57] ABSTRACT

An ink jet recording apparatus provided with: an ink jet recording head having a pressurizing chamber communicated with a nozzle opening and a common ink chamber, and a piezoelectric vibrating plate which is formed at a surface of the pressurizing chamber and deflection-displaced, the head being caused to eject an ink drop by the deflection displacement of the piezoelectric vibrating plate; a charging circuit which supplies a current to the piezoelectric vibrating plate in response to a print signal, thereby producing the deflection displacement for ink ejection, and which outputs a signal for holding a charge final voltage during a fixed time period after an end of charge; and a discharging circuit which has a first discharge time constant suitable for sucking meniscus formed immediately after ink ejection toward the pressurizing chamber, thereby preventing the meniscus from being ejected from the nozzle opening, which stops discharge in a range which is (n+¾) to (n+1) times (where n is 1, 2, 3, . . . , or 8) a natural vibration period T of the piezoelectric vibrating plate, and which conducts discharge at a second and different discharge time constant at an elapse of a predetermined time period.

13 Claims, 8 Drawing Sheets

40
41
42
R10
Q10
R11
Q11
Vref1
Q14
Q16
Q15
Q17
C
Q12
R12
Q13
R13
Vref2
COM
3
D
Tr
R16
R15
Q19
R14
Q18
R17
R18
R19
R20
Q20
Q22
Q27
Q25
Q26
Q23
Q24
VK
MCHG
CHG
DCHG1
DCHG2
DCHG3
DCHG

INK JET RECORDING APPARATUS

BACKGROUND OF THE INVENTION

1. Field of the Invention

The invention relates to an ink jet recording apparatus, and more particularly to an ink jet recording apparatus using a recording head in which a piezoelectric vibrating thin plate is stuck to a partial region of a pressurizing chamber communicated with a nozzle opening, and the pressurizing chamber is compressed by the piezoelectric vibrating plate to produce an ink drop.

2. Description of Related Art

As used in the description and in the appended claims, the words 'a charge time constant' mean a reciprocal number of the voltage gradient with respect to time when charging, and 'a discharge time constant' means a reciprocal number of the voltage gradient with respect to time when discharging.

Ink jet recording apparatuses which use a piezoelectric vibrating plate as an actuator for producing an ink drop are classified into those which utilize axial displacement of a piezoelectric vibrating plate having a bar-like shape, and those which utilize deflection displacement of a piezoelectric vibrating plate having a plate-like shape. The former ones have an advantage of a high-speed operation, but have a problem in that it is difficult to mount a piezoelectric vibrating plate and hence the production cost is increased.

By contrast, in the latter ones, a piezoelectric vibrating plate is stuck to a partial region of a vibrating plate constituting a pressurizing chamber, and the capacity of the pressurizing chamber is changed by deflection displacement of the piezoelectric vibrating plate, thereby producing an ink drop. Therefore, such apparatuses have advantages in that a large area of the pressurizing chamber can be displaced and an ink drop can stably be produced, and that the piezoelectric vibrating plate and the vibrating plate can simultaneously be formed and hence the production cost can be reduced. Since such apparatuses utilize deflection displacement, however, they have a drawback of a reduced damping force.

The reduced damping force causes the vibrating plate to move in response to an ink flow generated after ink ejection, so that there occur vibration in the meniscus as shown in FIG. 9 and the vibration is continued for a long time period. When the meniscus is moved toward the nozzle opening by the vibration of the meniscus, minute ink drops D' or so-called satellites are produced.

In order to solve the problem, a technique has been proposed in which, after ink ejection, a signal is applied to a piezoelectric vibrating plate so that a pressurizing chamber is expanded. In actuality, however, residual vibration is continued after discharge is ended, and hence there arises a problem in that, particularly in an ink jet recording head which responds at a high frequency, undesired ink drops are ejected when the meniscus is not pulled.

SUMMARY OF THE INVENTION

The invention has been conducted in view of these problems, and has as an object the provision of an ink jet recording apparatus using an ink jet recording head which can prevent undesired ink drops such as satellites from being ejected.

In order to solve the problems, the ink jet recording apparatus comprises: an ink jet recording head which comprises a pressurizing chamber communicated with a nozzle opening and a common ink chamber, and a piezoelectric vibrating plate which is formed at a surface of the pressurizing chamber and deflection-displaced, the head being caused to eject an ink drop by the deflection displacement of the piezoelectric vibrating plate; a charging circuit which supplies a current to the piezoelectric vibrating plate in response to a print signal, thereby producing the deflection displacement for ink ejection, and which outputs a signal for holding a charge final voltage during a fixed time period after an end of charge; and a discharging circuit which has a first discharge time constant suitable for sucking meniscus formed immediately after ink ejection toward the pressurizing chamber, thereby preventing the meniscus from being ejected from the nozzle opening, which stops discharge in a range which is (n+¾) to (n+1) times (where n is 1, 2, 3, . . . , or 8) a natural vibration period T of the piezoelectric vibrating plate, and which conducts discharge at a second and different discharge time constant at an elapse of a predetermined time period.

In a region where the movement of the meniscus caused by ink ejection is directed toward the nozzle opening, the instant when the natural vibration of the piezoelectric vibrating plate changes the state of the pressurizing chamber from contraction to expansion is captured. The discharge time constant is switched so that the piezoelectric vibrating plate is suppressed from again vibrating at the natural frequency. Thereby undesired ink drops are prevented from being ejected from the nozzle opening.

DETAILED DESCRIPTION OF THE PREFERRED EMBODIMENTS

Hereinafter, the invention will be described in detail by illustrating its embodiments shown in the accompanying drawings.

Figure 1:
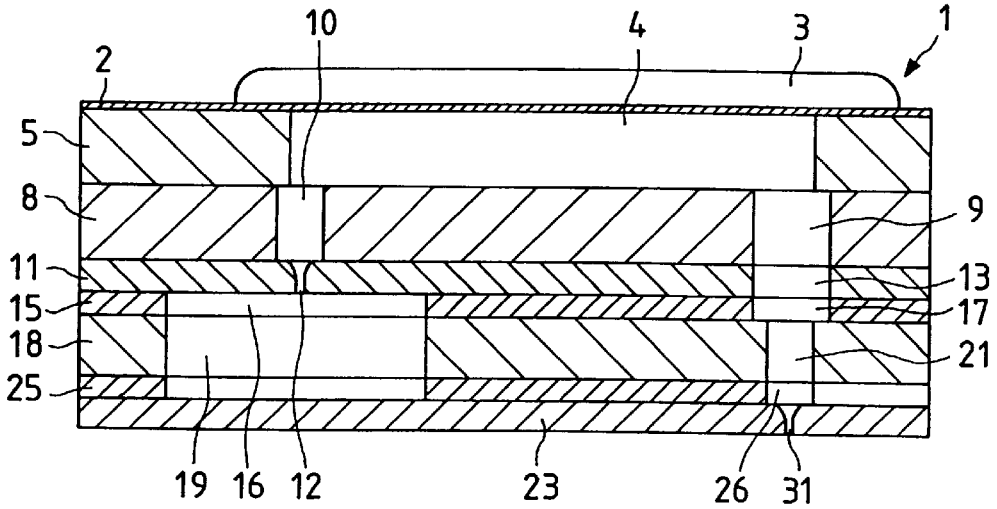
FIG. 1 is a section view showing an embodiment of an ink jet recording head according to the present invention.

FIG. 1 shows an embodiment of an ink jet recording head according to the invention. In FIG. 1, the reference numeral 1 designates a driving unit configured by integrally fixing piezoelectric vibrating plates 3 which are made of PZT (lead zirconate titanate), to the surface of a vibrating plate 2 which is made of a thin plate of zirconia having a thickness of about 10 μm, in such a manner that the vibrating plates respectively oppose pressurizing chambers 4 which will be described later.

The reference numeral 5 designates a spacer. In the spacer, through holes coincident in shape with the pressurizing chambers 4 are opened in a ceramics plate of zirconia ($ZrO_2$) or the like and having a thickness, for example, 150 μm suitable for the formation of the pressurizing chambers 4.

The reference numeral 8 designates a substrate which seals the other face of the pressurizing chambers 4. In the substrate, communicating holes 9 for connecting nozzle openings 31 to the pressurizing chambers 4 are opened in one end portion of the substrate on the side of the pressurizing chambers 4, and communicating holes 10 for connecting the pressurizing chambers 4 to a common ink chamber 19 are opened in the other end portion.

These three members 1, 5, and 8 are combined into one unit, and attached to a unit fixing plate 11 which will be described below.

The reference numeral 11 designates the unit fixing plate. In the unit fixing plate, the above-mentioned unit is fixed to a predetermined position of one face by an adhesive agent. Flow path restriction holes 12 having a flow resistance which is substantially equal to that of the nozzle openings 31 are opened at the interface between the communicating holes 10 and the common ink chamber 19. The flow path restriction holes serve as ink supply ports. Furthermore, communicating holes 13 connected to the nozzle openings 31 are opened at positions opposing the respective communicating holes 9.

The reference numeral 15 designates a hot gluing film for joining the unit fixing plate 11 to a common ink chamber plate 18 which will be described later. In the film, a window 16 coincident with the common ink chamber 19, and communicating holes 17 for connecting the nozzle openings 31 to the pressurizing chambers 4 are opened.

The reference numeral 18 designates the common ink chamber plate. The common ink chamber plate 18 includes a plate which has a thickness of, for example, 150 μm and suitable for the formation of the common ink chamber 19 and which is made of a corrosion-resistant material such as stainless steel. A through hole corresponding in shape to the common ink chamber 19, and communicating holes 21 for connecting the pressurizing chambers 4 to the nozzle openings 31 are opened in the common ink chamber plate.

The reference numeral 23 designates a nozzle plate where the nozzle openings 31 are opened in one end portion on the side of the pressurizing chambers 4. The nozzle plate is adhered to the common ink chamber plate 18 by a hot gluing film 25 so that the nozzle openings 31 are connected to the respective pressurizing chambers 4 via the communicating holes 9, 13, 17, 21, and 26.

In the ink jet recording head thus configured, when a drive signal wherein the voltage level is raised at a constant rate and applied to the piezoelectric vibrating plate 3, the vibrating plate 2 is deflected in such a manner that the portion on the side of the pressurizing chamber 4 is convex, thereby contracting the pressurizing chamber 4. This causes the ink in the pressurizing chamber 4 to reach the nozzle opening 31 via the communicating holes 9, 13, 17, 21, and 26, and an ink drop is ejected therefrom.

When the voltage level of the drive signal is lowered at a constant rate after the ink drop formation, the piezoelectric vibrating plate 3 gradually returns to its original state so that the pressurizing chamber 4 is expanded. During this process, an amount of ink equal to that consumed by the ink drop formation flows from the common ink chamber 19 into the pressurizing chamber 4 via the flow path restriction hole 12.

Figure 2:
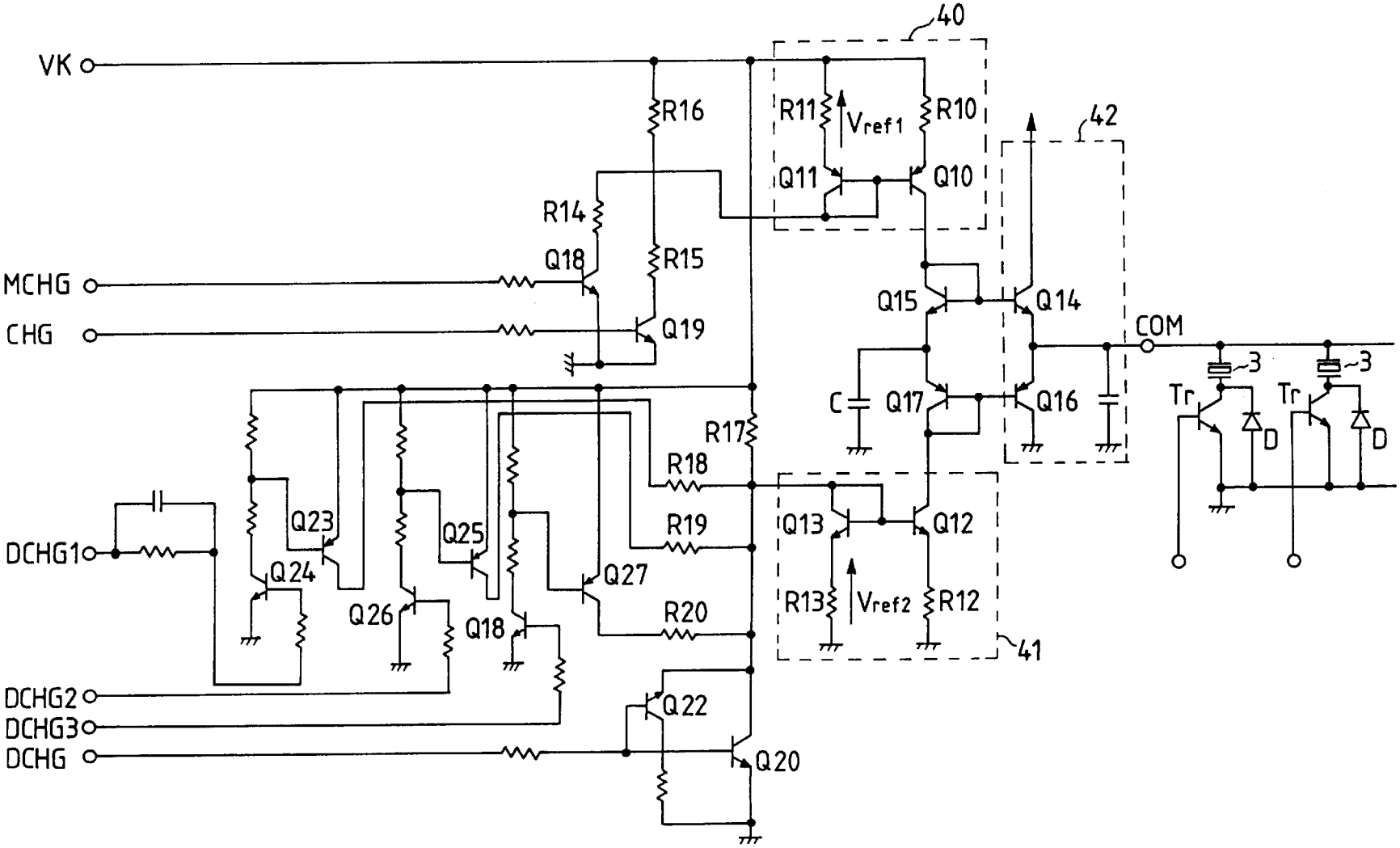
FIG. 2 is a circuit diagram showing an embodiment of a driving circuit according to the invention for driving the recording head.

FIG. 2 shows an embodiment of a driving circuit according to the invention for driving the recording head. In the figure, the reference numeral 40 designates a charging circuit for charging a capacitor C by a constant current, and comprises a pair of PNP transistors Q10 and Q11 which have the same characteristics and the bases of which are connected to each other, and resistors R10 and R11 which are connected between the emitters of the respective transistors and a constant voltage terminal VK. When a transistor Q18 is turned on by a print signal MCHG, a voltage difference of Vref1≈VK·R11/(R11+R14) is produced across the resistor R11. The voltage difference is reflected as it is in that across the emitter resistor R10 for the transistor Q10, and a constant current of Vref1/R10 flows out from the transistor Q10 so that the capacitor C is charged via a transistor Q15.

As a result, the terminal voltage of the capacitor C is raised at a constant voltage gradient. The terminal voltage of the capacitor C is supplied from a COM terminal of a current amplifying circuit 42 comprising transistors Q14 and Q16, to the piezoelectric vibrating plate 3.

The charge time constant of the capacitor C must be set so that the pressurizing chamber is contracted at a rate suitable for ink ejection. In the embodiment, the values of the resistors R11, R14, and R10, and the capacitor C are set so as to attain the rate of 12 V/μsec.

The reference numeral 41 designates a discharging circuit through which charges of the capacitor C are discharged at a constant current level. In a similar manner as the charging circuit 40, the discharging circuit comprises a pair of NPN transistors Q12 and Q13 which have the same characteristics and the bases of which are connected to each other, and resistors R12 and R13 which are connected between the emitters of the respective transistors and GND. When a transistor Q20 is turned off by a discharge signal DCHG, the transistor Q13 is turned on so that a predetermined voltage difference Vref2 which will be described later is produced across the resistor R13. The voltage difference is reflected as it is in that across the emitter resistor R12 for the transistor Q12, and hence the transistor Q12 absorbs charges of the capacitor C at a constant current level which is determined by Vref2/R12, thereby discharge the capacitor C.

Next, the operation of the thus configured apparatus will be described with reference to FIG. 3.

When the print signal MCHG is input (time t0), the charging circuit 40 operates as described above, and the capacitor C is charged at a constant current level. This causes the terminal voltage of the capacitor C to be suddenly raised at a constant gradient. The terminal voltage of the capacitor C is output from the COM terminal via the current amplifying circuit 42. The output voltage at the COM terminal is selectively applied to the piezoelectric vibrating plate 3 via a transistor Tr which is turned on by a print data signal.

The voltage application causes the piezoelectric vibrating plate 3 to be deflection-displaced in such a manner that the portion of the vibrating plate 2 on the side of the pressurizing chamber 4 is convex, whereby the ink in the pressurizing chamber 4 is pressurized and ink is ejected from the corresponding nozzle opening 31. At the same time, the piezoelectric vibrating plate 3 starts vibration of a natural vibration period T. In the vibration, the average amplitude is the static displacement caused by the applied voltage, the amplitude is superposed on the average amplitude, and the start point is set at the start of charge.

At time t1, the capacitor C is sufficiently charged so that the output voltage at the COM terminal reaches the saturation voltage. When a given time period Th1 is then elapsed, or at time t2, the print signal MCHG is set to be off, and the discharge signal DCHG is output so as to cause the discharging circuit 41 to operate.

The time t2 is set to be at an instant when the dynamic displacement of the piezoelectric vibrating plate 3 with respect to the reference which is the static displacement position is directed so as to expand the pressurizing chamber 4. At the same time, an auxiliary discharge signal DCHG1 is set to be HIGH so that a transistor Q24 is turned on and a transistor Q23 is turned on.

This produces a state substantially equivalent to that where a resistor R18 is connected in parallel to a resistor R17. The voltage Vref2 across the resistor R13 is given by $$Vref2 \approx VK \cdot R13/(R17\text{–}18+R13)$$

where R17–18 indicates the combined resistance of the parallel resistors R17 and R18.

The capacitor C is discharged by a constant current Is (Is=Vref2/R12) which is based on the voltage Vref2, and the terminal voltage of the capacitor C is lowered at a given discharge time constant. The terminal voltage of the capacitor C is supplied via the current amplifying circuit 42 to the piezoelectric vibrating plate 3 which is in the selected state for printing.

Figure 9:
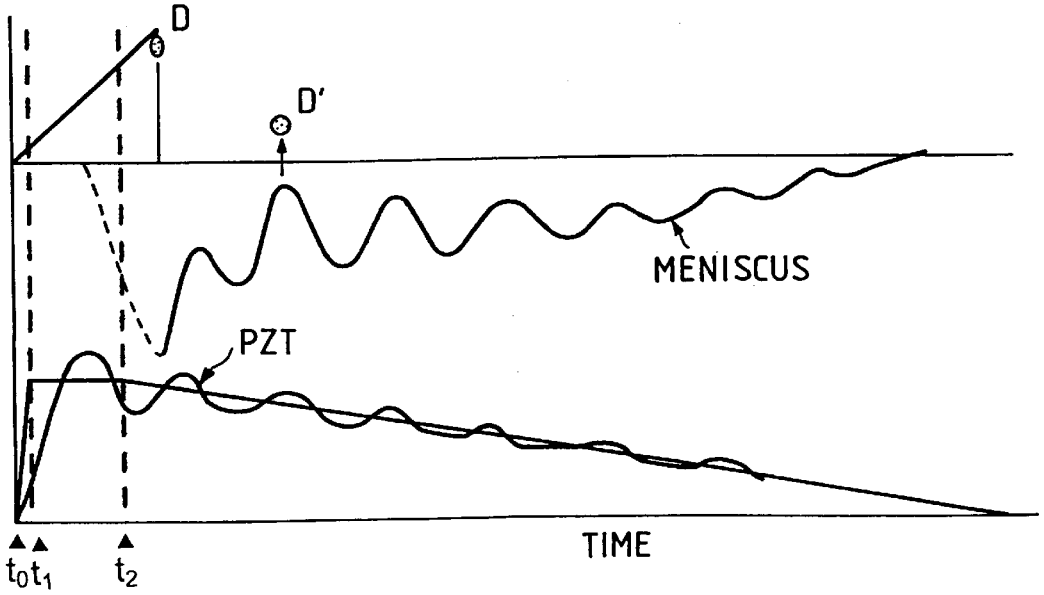
FIG. 9 PRIOR ART
FIG. 9 is a view showing relationships between the movement of the meniscus, the natural vibration of the piezoelectric vibrating plate, and the driving waveform in a recording head using deflection vibration.

This allows the displacement of the vibrating plate 2 which has been in the state where the portion on the side of the pressurizing chamber 4 is convex, to be gradually released, so that the pressurizing chamber 4 is expanded. Therefore, the meniscus produced in the vicinity of the nozzle opening 31 is pulled toward the pressurizing chamber 4, whereby ejection of minute ink drops D' (see FIG. 9) after ink ejection is prevented from occurring, and ink in the common ink chamber 19 is caused to flow into the pressurizing chamber 4 via the ink supply port 12.

In the embodiment, in order to prevent such ejection of undesired ink drops from occurring, the circuit constants are set so that the voltage is lowered at a discharge voltage gradient of, for example, about 0.33 V/μsec.

In other words, when the discharge voltage gradient is smaller than 0.33 V/μsec., the force of pulling the meniscus is so small that ejection of undesired minute ink drops D' cannot be prevented from occurring. When the discharge voltage gradient is very much larger than 0.33 V/μsec., such a large discharge time constant rather causes the meniscus to vibrate, thereby causing the undesirable ejecting of the minute ink drops.

On the other hand, the meniscus, immediately after ink ejection, is largely pulled into the pressurizing chamber 4. When a predetermined time period is elapsed, the movement direction of the meniscus is inverted, and the meniscus moves toward the nozzle opening 31 while repeating vibration which is synchronized with the natural vibration of the piezoelectric vibrating plate 3.

When a time period which is (n+¾) to (n+1) times the natural vibration period T is elapsed after time t0 when the piezoelectric vibrating plate 3 starts to be deflection-displaced, or, in the embodiment, at time t3 when a time of T×(3+¾), the discharge signal DCHG is set to be HIGH and the auxiliary discharge signal DCHG1 is set to be LOW so that discharge is temporarily stopped.

As a result, a force for stopping the residual vibration acts on the piezoelectric vibrating plate 3. After this time, therefore, the force of the meniscus vibrating in synchronization with the natural vibration of the piezoelectric vibrating plate 3 which force is directed to the nozzle opening 31 is reduced.

Figure 4:
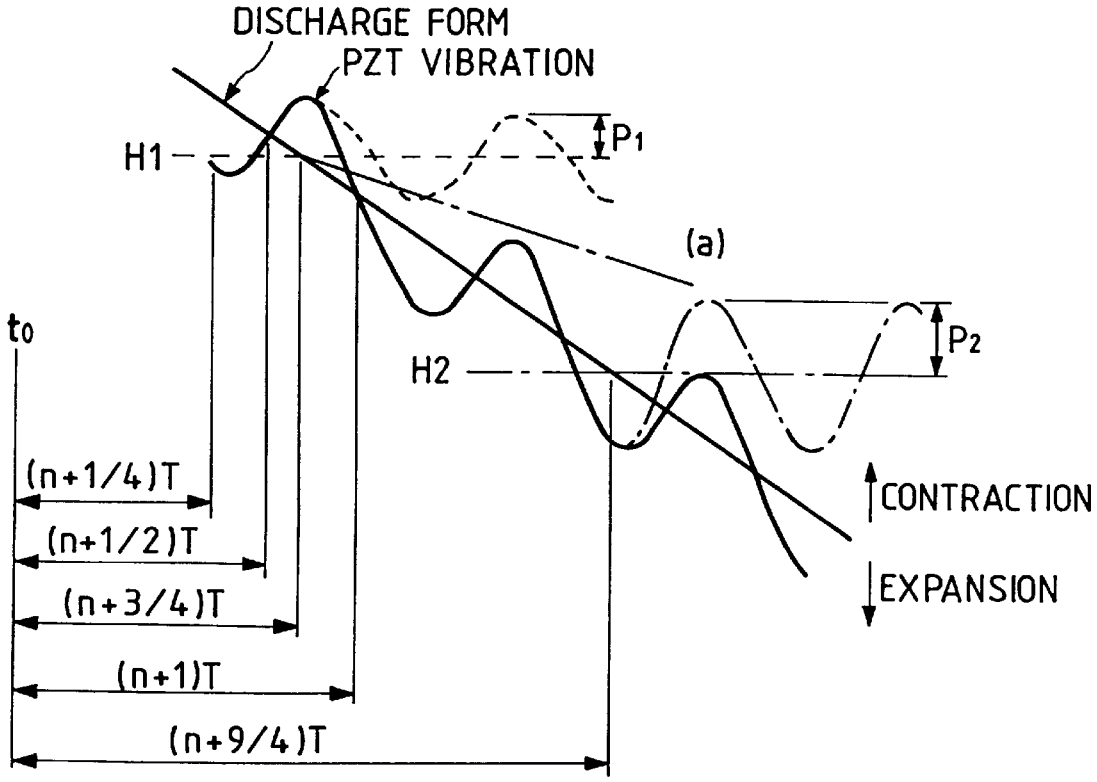
FIG. 4 is a diagram showing a behavior of a piezoelectric vibrating plate which is conducted after a stop of discharge.

In other words, as shown in FIG. 4, if the discharged is stopped when the natural vibration of the piezoelectric vibrating plate 3 (in the figure, indicated by PZT) causes the pressurizing chamber 4 to contract and the direction is then inverted so as to expand the chamber, displacement deviation P1 from a static displacement position H1 of the piezoelectric vibrating plate 3 is suddenly reduced and the piezoelectric vibrating plate 3 is suppressed from again vibrating. As a result, the vibration of the meniscus directed to the nozzle opening 31 is reduced and hence ejection of undesired ink drops is blocked.

In the above, the configuration in which discharge is stopped has been described. Alternatively, as indicated by (a) in FIG. 4, the discharge time constant may be switched so as to be increased. In the alternative, the timing of the switching is set to the instant when a time period which is (n+¾) to (n+1) times the natural vibration period T is elapsed. Also in the alternative, the vibration of the piezoelectric vibrating plate 3 can effectively be suppressed.

Next, the case where discharge is accidentally stopped will be described. It is assumed that discharge is stopped when the natural vibration of the piezoelectric vibrating plate 3 causes the pressurizing chamber 4 to expand and the direction is then inverted so as to contract the chamber, or at the instant of, for example, (n+¾)T shown in FIG. 4. In this case, the piezoelectric vibrating plate 3 is caused to start to vibrate, and displacement deviation P2 from a static displacement position H2 of the piezoelectric vibrating plate 3 is suddenly increased. Accompanying with the increase of the deviation, the vibration of the meniscus is increased in magnitude, and hence the possibility of ejection of undesired ink drops is increased to a very high level.

When a time period Th2 is elapsed after time t3, the discharge signal DCHG is again set to be LOW so as to cause the discharging circuit 41 to operate. This makes the pressurizing chamber 4 to expand so that ink is sucked from the common ink chamber 19.

During this process, since the auxiliary discharge signal DCHG1 is LOW and the transistor Q23 is turned off, the voltage Vref2 across the resistor R13 is Vref2≈VK·R13/(R17+R13). Consequently, the capacitor C is discharged at a current which is smaller in level than the current Is.

As a result, discharge is conducted at a second discharge time constant which produces a voltage variation of, for example, 0.14 V/μsec. which is smaller than that produced in the discharge between times t2 to t3. The expansion of the pressurizing chamber caused by this discharge expedites the forced return of the meniscus toward the nozzle opening.

When most of the charges are lost and discharge is in a state just before the end, or when the terminal voltage of the piezoelectric vibrating plate is lowered to about 8 to 12% of the driving voltage (time t4), the auxiliary discharge signal DCHG1 is again set to be HIGH, whereby discharge is suddenly conducted at a third discharge time constant which is a voltage gradient with respect to time of about 0.33 V/μsec. is produced, until the charges are completely lost.

This sudden discharge causes the pressurizing chamber 4 to rapidly expand by a small degree. As a result, the meniscus is suddenly pulled in by a small degree. Accompanying with this pull-in, ink existing in a portion in the vicinity of the nozzle opening 31 and including the nozzle plate face is pulled in toward the pressurizing chamber 4. The meniscus itself is stabilized at a concave state in the nozzle. Consequently, the amount of ink which is to be ejected at the next time is controlled to be constant, and bending of the flight path of ejected ink which may be caused by ink remaining in the periphery of the nozzle opening does not occur.

In the embodiment, signals CHG, DCHG2, and DCHG3 shown in FIG. 2 are always kept to be LOW.

The value n is selected to be "3" in the embodiment. The value n is determined in accordance a tradeoff between the function of effectively damping the residual vibration of the piezoelectric vibrating plate 3, and that of sufficiently expediting the return of the meniscus. Generally, it is adequate to set the value n to be in the range of 1 to 8, preferably in the range of 2 to 4.

Figure 5:
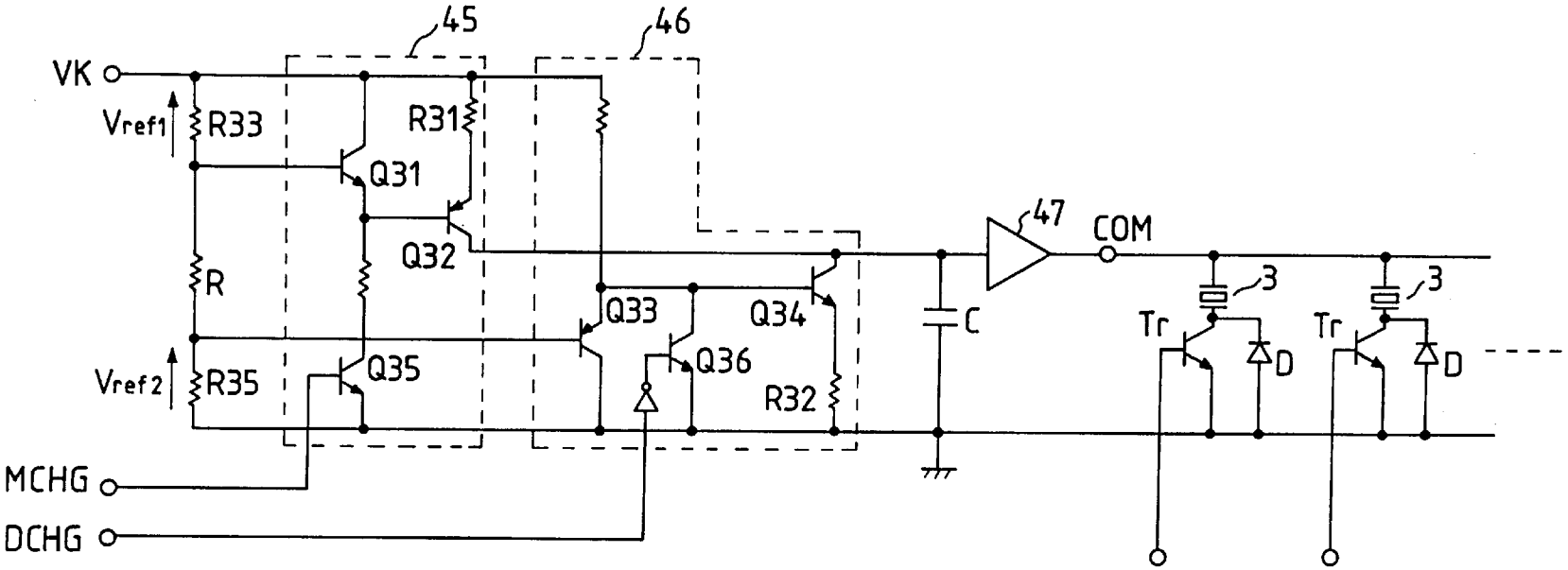
FIG. 5 is a circuit diagram showing another embodiment of a driving circuit according to the invention.

Next, a second embodiment of the invention will be described with reference to FIG. 5.

In the figure, the reference numeral 45 designates a charging circuit which comprises complementary transistors Q31 and Q32, and a resistor R31 connected between the emitter of the transistor Q32 and a constant voltage terminal VK. When a transistor Q35 is turned on by the print signal MCHG, the charging circuit starts to operate so that a capacitor C is charged via the resistor R31 at a constant current level.

The charging circuit 45 charges the capacitor C at the constant current If (If=Vref1/R31) which is not affected by the environmental temperature or is uniquely determined depending on the voltage difference Vref1 across a resistor R33. This causes the terminal voltage of the capacitor C to be raised at a constant voltage gradient, and the terminal voltage is selectively supplied to the piezoelectric vibrating plate 3 via a current amplifying circuit 47.

In the same manner as the embodiment described above, the charge time constant Tc is set to be a value at which the vibrating plate 2 is deflected toward the pressurizing chamber, and the piezoelectric vibrating plate 3 is deflection-displaced so as to contract the pressurizing chamber 4 at a rate suitable for ink ejection. For example, the charge time constant is set to produce the voltage gradient about 12 V/μsec.

The reference numeral 46 designates a discharging circuit which comprises complementary transistors Q33 and Q34, and a resistor R32 connected between the emitter of the transistor Q34 and GND. When a transistor Q36 is turned off by the discharge signal DCHG, the discharging circuit starts to operate so that the capacitor C is discharged at a constant current Is (Is=Vref2/R32) which is not affected by the environmental temperature or is uniquely determined depending on the voltage difference Vref2 across a resistor R35.

The discharge time constant Td is selected to be a value (for example, its voltage gradient to be about 0.66 V/μsec.) at which the vibration of the meniscus immediately after ink drop ejection does not protrude from the nozzle opening 31, and discharge is ended at an instant when a time period which is (n'+¾) to (n'+1) times the natural vibration period T of the piezoelectric vibrating plates 3 is elapsed (where n' is generally an integer in the range of 1 to 8, and preferably an integer in the range of 2 to 4).

Next, the operation of the thus configured apparatus will be described with reference to FIG. 6.

When the print signal MCHG is input, the charging circuit 45 operates, and the capacitor C is charged at the constant charge time constant Tc. This causes the terminal voltage of the capacitor C to be suddenly raised to a predetermined voltage. The terminal voltage of the capacitor C is applied to the piezoelectric vibrating plate 3 via the current amplifying circuit 47 and a transistor Tr which is turned on by the print data signal for selecting the nozzle opening 31 from which ink is to be ejected.

Consequently, the piezoelectric vibrating plate 3 causes the vibrating plate 2 to be deflection-displaced in such a manner that the portion on the side of the pressurizing chamber 4 is convex, whereby the ink in the pressurizing chamber 4 is pressurized and ink is ejected from the nozzle opening 31.

On the other hand, the piezoelectric vibrating plate 3 starts vibration in which the average amplitude is the static displacement caused by the applied voltage, the amplitude is superposed on the average amplitude, and the start point is set at the start of charge. When a hold time period Th is then elapsed, or at time t2, the print signal MCHG is set to be off, and the discharge signal DCHG is output so as to cause the discharging circuit 46 to operate. Then the capacitor C is discharged at the discharge time constant Td and the terminal voltage of the capacitor C is lowered at a constant rate.

The time t2 is set to be at an instant when the dynamic displacement of the piezoelectric vibrating plate 3 with respect to the reference which is the static displacement position of the piezoelectric vibrating plate 3 is directed so as to expand the pressurizing chamber 4.

The lowered terminal voltage of the capacitor C causes the piezoelectric vibrating plate 3 to start the operation of returning to its original state so that the pressurizing chamber 4 is expanded at a constant rate. At time t3 or when a time period which is (n'+¾) to (n'+1) times the natural vibration period T of the piezoelectric vibrating plate 3 is then elapsed, the discharge is completely ended.

Figure 6A:
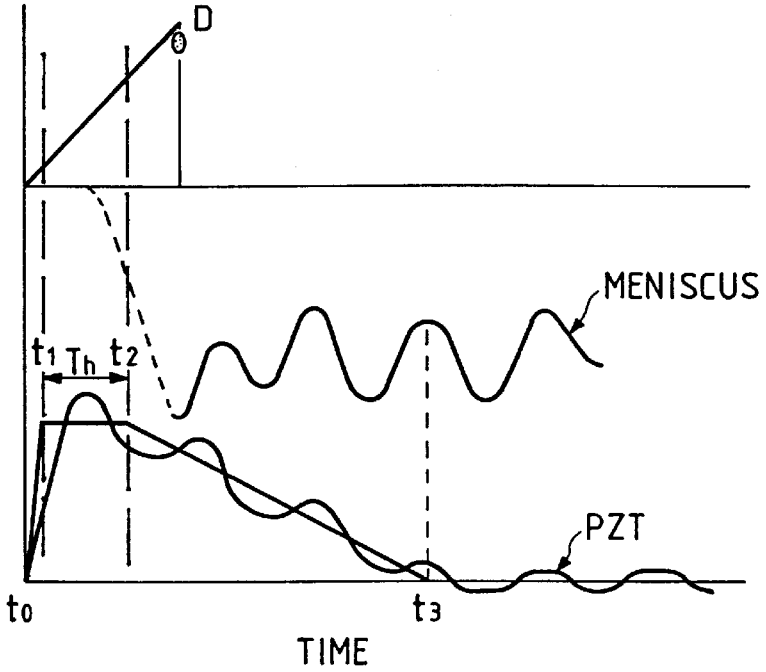
FIGS. 6(A) and 6(B) are views showing behaviors of a piezoelectric vibrating plate which are conducted after different stop timings of discharge.

As shown in FIG. 6(A), this results in that the discharge is stopped at time t3 when the natural vibration of the piezoelectric vibrating plate 3 (in the figure, indicated by PZT) causes the pressurizing chamber 4 to contract and the direction is then inverted so as to expand the chamber. Because of the same function as that which has been described with reference to FIG. 4, the residual vibration of the piezoelectric vibrating plate 3 conducted thereafter is rapidly damped, and no ink drop is ejected until the next print signal is input.

In the embodiment, the time period between times t0 to t3 is set to be (3+¾) times the natural vibration period T, and the damping function is exerted in a time period which is (3+¾) to (3+1) times the natural vibration period T.

Figure 6B:
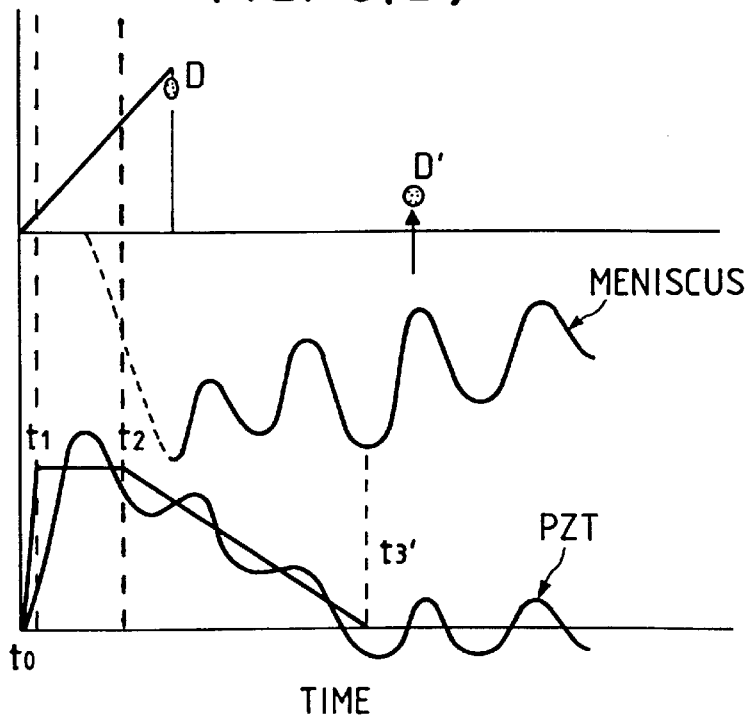

Conversely, in the case where the discharge is stopped at time t3' when the natural vibration causes the pressurizing chamber 4 to expand and the direction is then inverted so as to contract the chamber as shown in FIG. 6(B), the piezoelectric vibrating plate 3 then vibrates with a larger amplitude, resulting in that the possibility of ejection of undesired ink drops before the input of the next print signal is increased.

When the charging operation causes the pressurizing chamber 4 to contract so as to eject an ink drop, the meniscus in the vicinity of the nozzle opening starts to vibrate. As described above, the hold time period is provided in order to hold for a given period the voltage appearing at the end of charge, and the piezoelectric vibrating plate 3 is discharged after an elapse of the hold time period in order to prepare for the next ink drop ejection. It has been found that, when the hold time period is set so as to satisfy a specific relationship with respect to the natural vibration period T of the meniscus, the vibration of the meniscus can be suppressed more effectively.

Figure 7:
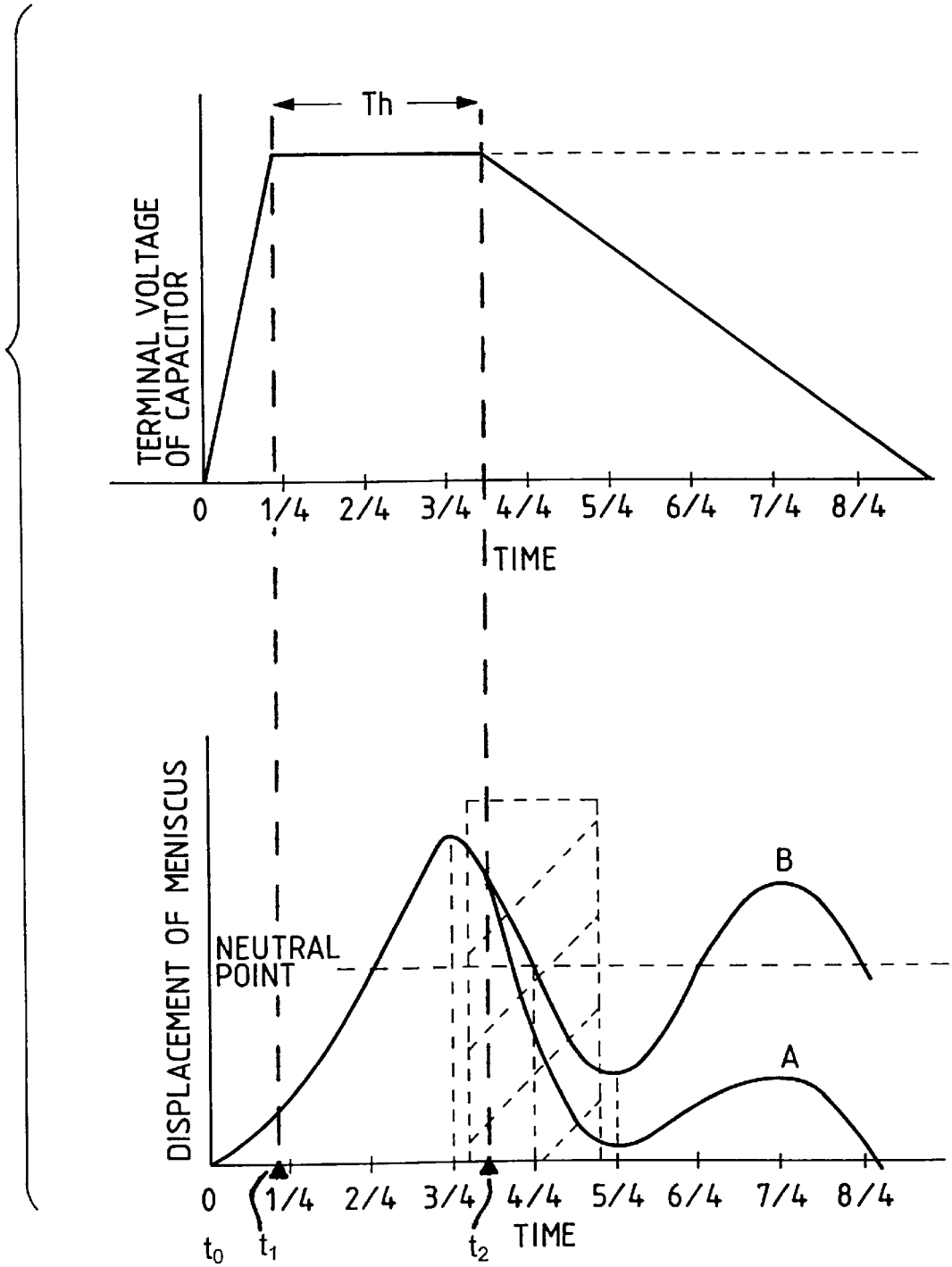
FIG. 7 is a graph showing relationships between a timing of starting discharge and the movement of the meniscus.

Specifically, when the charging voltage after the end of charge is maintained at a constant level, as indicated by a curve B of FIG. 7, the meniscus receives the energy produced at ink drop ejection and conducts free vibration with setting the neutral point in the vicinity of the nozzle opening as the center, and at the natural vibration period T. When the meniscus moves toward the nozzle opening, minute ink drops called satellites which may impair the print quality are ejected.

During the time period from the time when charge is started in order to eject an ink drop to be used in printing to that when the time period which is ¾ to ⁵⁄₄ times the natural vibration period T, the meniscus is located on the side of the pressurizing chamber. When the start timing of discharge or the end of the hold time period is set to be in this time period (¾ to ⁵⁄₄ times the natural vibration period T), therefore, the force of pulling the meniscus due to expansion of the pressurizing chamber 4 which is caused by discharge of the piezoelectric vibrating plate 3 conducted after the end of the hold time period as indicated by a curve A of FIG. 7 synergistically acts on the movement of the meniscus itself toward the pressurizing chamber.

This synergistic pulling of the meniscus enables the meniscus which may possibly produce satellites when it moves next toward the nozzle opening, to be sufficiently pulled in toward the pressurizing chamber.

Of course, the pressurizing chamber 4, the nozzle opening 31, and changes of characteristics of ink, and variations of constants of the devices constituting the driving circuit may be considered. In this case, preferably, the timing is set to be in the range of about plus and minus T/4 (hatched portion in FIG. 7) with respect to the time when the free vibration of the meniscus produced after ink drop ejection reaches the neutral point, or the time when the natural vibration period T is elapsed after the start of charge.

Figure 8:
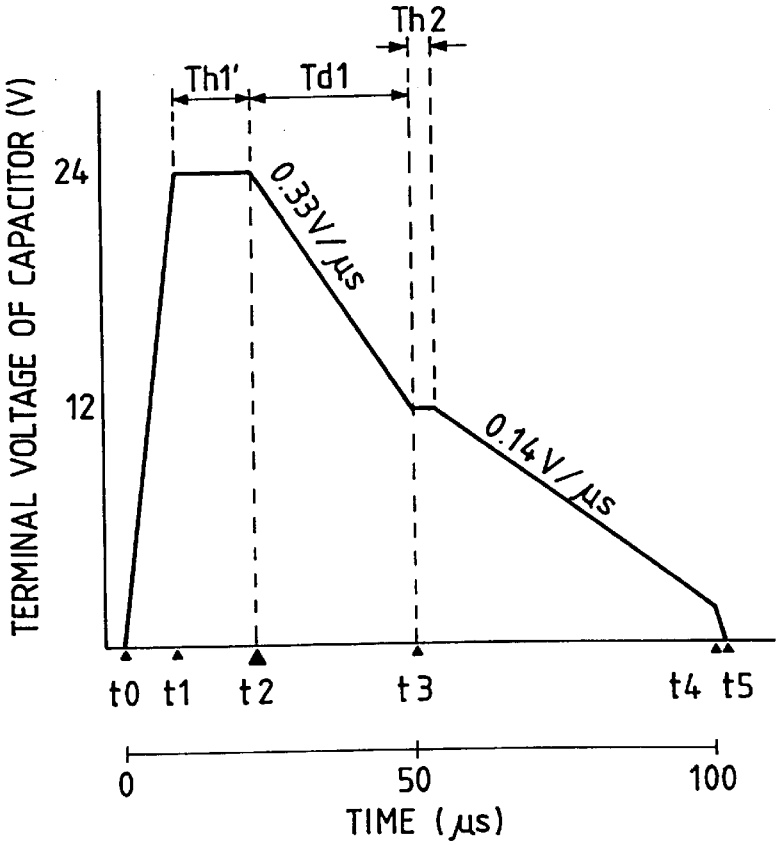
FIG. 8 is a view showing another embodiment of the invention in terms of a driving waveform and the vibration form of the meniscus.

As shown in FIG. 8, therefore, a hold time period Th1' is adjusted so that the time period from the start of charge to time t2 when discharge is started is within a time period which is ¾ to ⁵⁄₄ times the natural vibration period T, preferably 0.8 to 1.2 times the period T, so that the movement of the meniscus which is generated after the time of ink drop ejection and directed to the pressurizing chamber is effectively utilized to sufficiently pulling the meniscus toward the pressurizing chamber.

Figure 3:
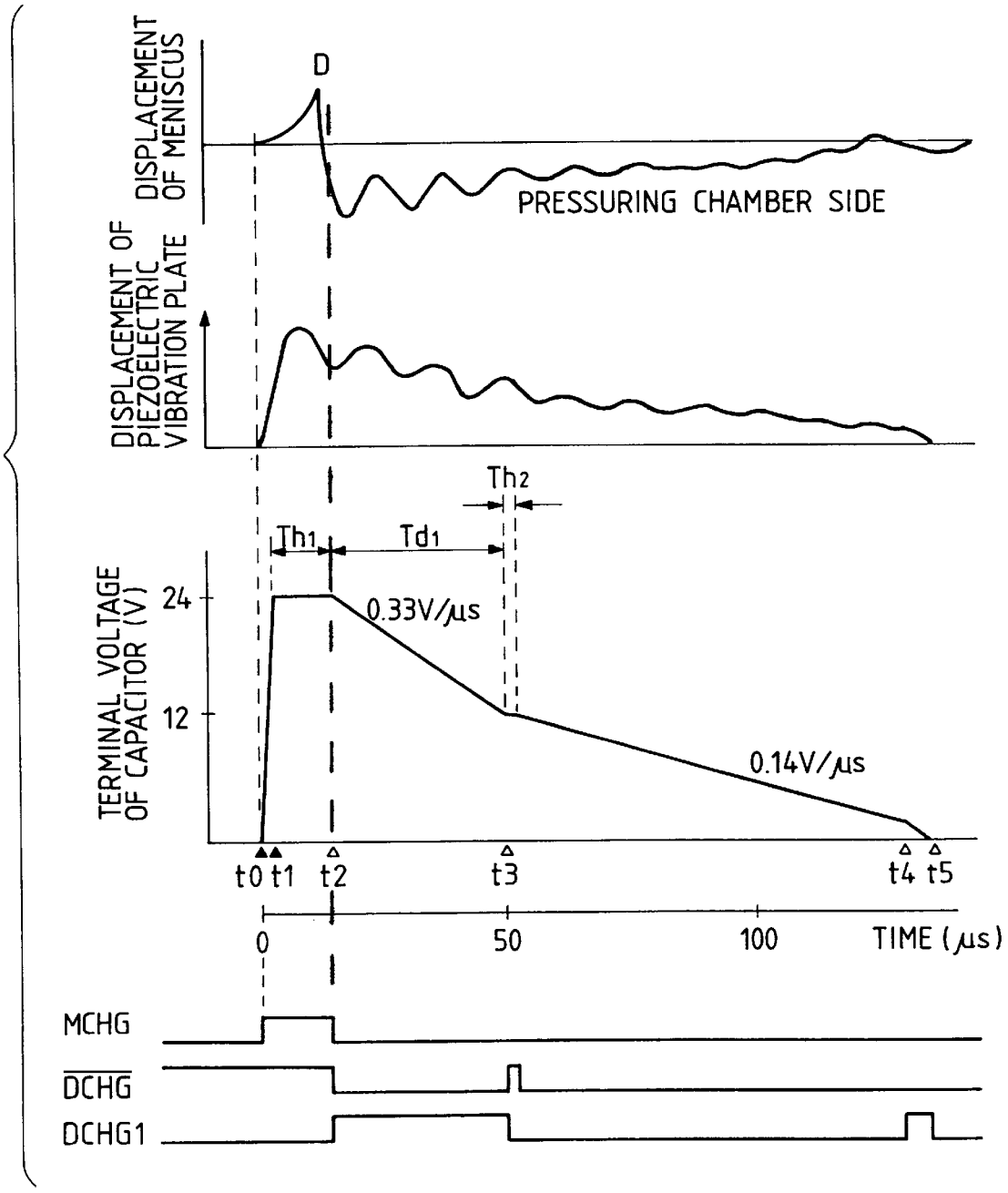
FIG. 3 is a waveform chart showing the operation of the apparatus.

In the same manner as the embodiment shown in FIG. 3, thereafter, when the discharge period Td1 is elapsed or at time t3, discharge is stopped for a predetermined time period Th2. Then second discharge is conducted at a discharge time constant which is larger than the first discharge time constant, and, immediately before the end of discharge, or at time t4 when the terminal voltage of the piezoelectric vibrating plate is lowered to about 8 to 12% of the driving voltage, discharge is ended at a third discharge time constant which is smaller than the first discharge time constant, whereby the printing speed can be improved while satellites are prevented more surely from occurring and the residual vibration is suppressed.

Figure 10A:
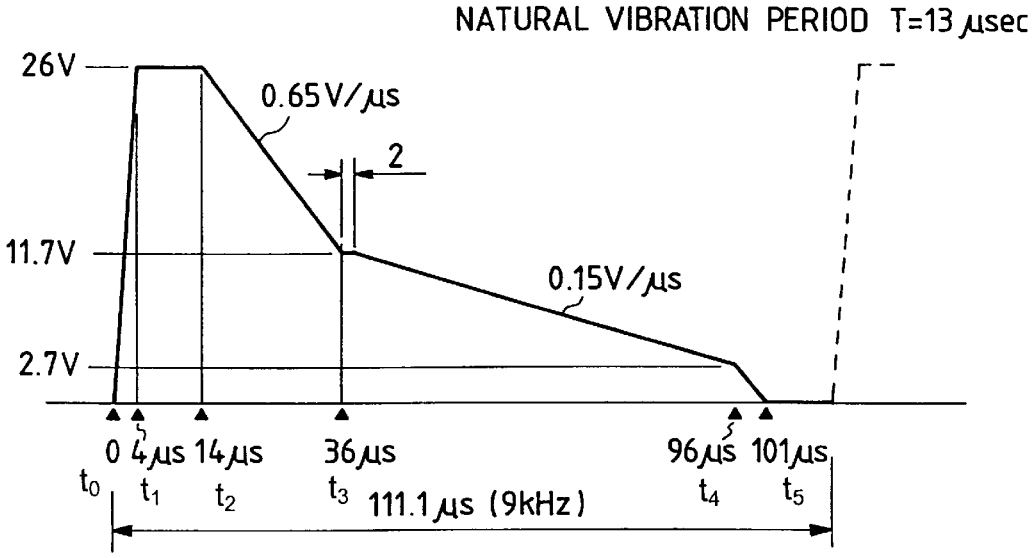
FIGS. 10(A) and 10(B) are a view showing specific driving conditions of an ink jet to which the invention is applied.
Figure 10B:
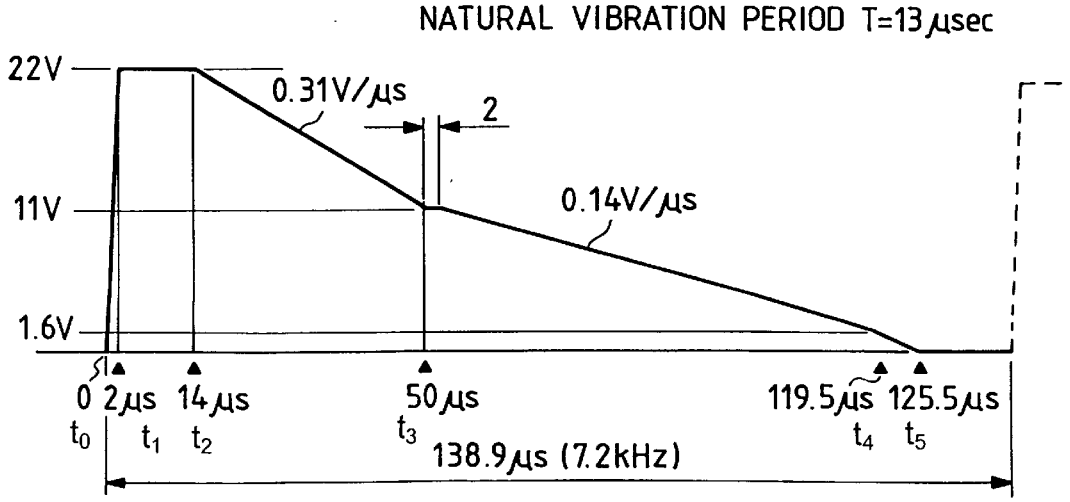

FIGS. 10(A) and 10(B) show driving waveforms applied to a recording head in which the natural vibration period T of a piezoelectric vibrating plate is 13 μsec. FIG. 10(A) shows a waveform in the case where the maximum driving frequency is 9 kHz, and FIG. 10(B) a waveform in the case where the maximum driving frequency is 7.2 kHz.

When the recording head is driven as described above, printing of an excellent quality is achieved at a predetermined printing speed and without ejecting undesired satellite ink drops.

As described above, according to the invention, discharge of a piezoelectric vibrating plate which is once displaced toward the pressurizing chamber to form a convex state, thereby ejecting ink, and which is then deflection-displaced is switched so as to be conducted at different time constants, temporarily stopped, or ended in a process of returning the piezoelectric vibrating plate to the original position and in a time period which is (n+¾) to (n+1) times (where n is 1, 2, 3, . . . , or 8) the natural vibration period T of the piezoelectric vibrating plate. Therefore, vibration of the piezoelectric vibrating plate with respect to the reference which is the static displacement position can be suppressed, and ejection of undesired ink drops from the nozzle opening can surely be prevented from occurring.

Furthermore, since steep discharge is conducted immediately before the end of discharge, ink in the vicinity of the nozzle opening can be pulled into the nozzle opening, and the meniscus can be pulled toward the pressurizing chamber, so that the meniscus is stabilized at a concave state. This enables the amount of ejected ink to be controlled, and prevents the flight path of ejected ink from being bent.

What is claimed is:

1. An ink jet recording apparatus for ejecting an ink drop in accordance with a print signal, said ink jet recording apparatus comprising:

an ink jet recording head, including;

a nozzle opening, a common ink chamber, a pressurizing chamber communicated with said nozzle opening and said common ink chamber, and a piezoelectric vibrating plate formed at a surface of said pressurizing chamber, said piezoelectric vibrating plate being deflectable and having a natural vibration period T, wherein said ink jet recording head ejects the ink drop by deflection displacement of said piezoelectric vibrating plate;

a charging circuit supplying electric current to said piezoelectric vibrating plate during a charging period in response to the print signal, thereby producing the deflection displacement for ejecting the ink drop, and outputting a signal for holding a charge final voltage during a first holding period after an end of the charging period; and a discharging circuit discharging the piezoelectric vibrating plate at a first discharge time constant, immediately after the holding period, during a first discharge period, the first discharge time constant causing a meniscus formed immediately after the ejecting of the ink drop to be sucked toward said pressurizing chamber thereby preventing the meniscus from being ejected from said nozzle opening, the first discharge period ending, with respect to the start of the charging period, at a time in a range which is:

$(n+\frac{3}{4})\cdot T$ to $(n+1)\cdot T$, where n is an integer and $1 \leqq n \leqq 8$:

the discharging circuit, after the end of the first discharge period, discharging the piezoelectric vibrating plate at a second discharge time constant during a second discharge period, the second discharge time constant being different from the first discharge time constant.

2. An ink jet recording apparatus according to claim 1, wherein $2 \leqq n \leqq 4$.

3. An ink jet recording apparatus according to claim 1, wherein:

a second holding period is provided after the first discharge period and before the second discharge period; and during said second holding period, a voltage at the end of the first discharge period is maintained.

4. An ink jet recording apparatus according to claim 1, wherein:

the second discharge period ends before an end of discharge of the piezoelectric vibrating plate, said discharging circuit, immediately after the end of the second discharge period, discharges the piezoelectric vibrating plate at a third discharge time constant during a third discharge period which ends at the end of discharge of the piezoelectric vibrating plate, and said third discharge time constant is smaller than said second discharge time constant.

5. An ink jet recording apparatus for ejecting an ink drop in accordance with a print signal, said ink jet recording apparatus comprising:

an ink jet recording head, including;

a nozzle opening, a common ink chamber, a pressurizing chamber communicated with said nozzle opening and said common ink chamber, and a piezoelectric vibrating plate formed at a surface of said pressurizing chamber, said piezoelectric vibrating plate being deflectable and having a natural vibration period T, wherein said ink jet recording head ejects the ink drop by deflection displacement of said piezoelectric vibrating plate;

a charging circuit supplying electric current to said piezoelectric vibrating plate during a charging period in response to the print signal, thereby producing the deflection displacement for ejecting the ink drop, and outputting a signal for holding a charge final voltage during a first holding period after an end of the charging period; and a discharging circuit discharging the piezoelectric vibrating plate at a first discharge time constant, immediately after the holding period, during a first discharge period, the first discharge time constant causing a meniscus formed immediately after the ejecting of the ink drop to be sucked toward said pressurizing chamber thereby preventing the meniscus from being ejected from said nozzle opening, the first discharge period ending, with respect to the start of the charging period, at a time in a range which is:

$(n'+3/4)\cdot T$ to $(n'+1)\cdot T$, where n' is an integer and $1 \leqq n' \leqq 8$.

6. An ink jet recording apparatus according to claim 5, wherein $2 \leqq n' \leqq 4$.

7. An ink jet recording apparatus for ejecting an ink drop in accordance with a print signal, said ink jet recording apparatus comprising:

an ink jet recording head, including;

a nozzle opening, a common ink chamber, a pressurizing chamber communicated with said nozzle opening and said common ink chamber, and a piezoelectric vibrating plate formed at a surface of said pressurizing chamber, said piezoelectric vibrating plate being deflectable and having a natural vibration period T, wherein said ink jet recording head ejects the ink drop by deflection displacement of said piezoelectric vibrating plate;

a charging circuit supplying electric current to said piezoelectric vibrating plate during a charging period in response to the print signal, thereby producing the deflection displacement for ejecting the ink drop, and outputting a signal for holding a charge final voltage during a first holding period after an end of the charging period; and a discharging circuit discharging the piezoelectric vibrating plate at a first discharge time constant during a first discharge period, the first discharge time constant causing a meniscus formed immediately after the ejecting of the ink drop to be sucked toward said pressurizing chamber thereby preventing the meniscus from being ejected from said nozzle opening, the first discharge period starting at a time which is $3/4\cdot T$ to $5/4\cdot T$ after the start of the charging period;

wherein, after the end of the first discharge period, there is provided a holding period during which the discharge of the piezoelectric vibrating plate temporarily is stopped; and wherein, after the temporary stop, there is provided a second discharge period during which the discharging circuit discharges the piezoelectric vibrating plate at a second discharge time constant, the second discharge time constant being larger than the first discharge time constant.

8. An ink jet recording apparatus according to claim 7, wherein:

the second discharge period ends before an end of discharge of the piezoelectric vibrating plate, said discharging circuit, immediately after the end of the second discharge period, discharges the piezoelectric vibrating plate at a third discharge time constant during a third discharge period, and said third discharge time constant is smaller than said second discharge time constant.

9. An ink jet recording apparatus according to claim 7, wherein the first discharge period starts at a time which is $0.8\cdot T$ to $1.2\cdot T$ after the start of the charging period.

10. An ink jet recording apparatus for ejecting an ink drop in accordance with a print signal, said ink jet recording apparatus comprising:

an ink jet recording head, including:

a nozzle opening;

a common ink chamber;

a pressurizing chamber communicated with said nozzle opening and said common ink chamber;

a piezoelectric vibrating plate formed at a surface of said pressurizing chamber, said piezoelectric vibrating plate being deflectable and having a natural vibration period T, wherein said ink jet recording head ejects the ink drop by deflection displacement of said piezoelectric vibrating plate;

a driving circuit comprising a charging circuit for charging said piezoelectric vibrating plate, and a discharging circuit for discharging said piezoelectric vibrating plate;

a charging period starting in response to said print signal, and during which said charging circuit supplies electric current to said piezoelectric vibrating plate thereby to produce said deflection displacement;

a first holding period starting immediately after the end of said charging period, and during which said driving circuit maintains a charge final voltage of said piezoelectric vibrating plate;

a first discharge period starting immediately after the end of said first holding period at a time which is $3/4\cdot T$ to $5/4\cdot T$ after the start of the charging period, ending at a time which is $(n+3/4)\cdot T$ to $(n+1)\cdot T$ after the start of the charging period, where n is an integer and $1 \leqq n \leqq 8$, and during which said discharging circuit discharges said piezoelectric vibrating plate at a first discharge time constant which causes a meniscus that is formed immediately after the ejecting of the ink drop to be sucked toward said pressurizing chamber and thereby prevents said meniscus from being ejected from said nozzle opening;

a second holding period starting immediately after the end of said first holding period, and during which said driving circuit temporarily stops discharging said piezoelectric vibrating plate; and a second discharge period starting after the end of said first discharge period, and during which said discharging circuit further discharges the piezoelectric vibrating plate at a second discharge time constant different from the first discharge time constant.

11. The ink jet recording apparatus according to claim 10, further comprising:

said second discharge period ending before an end of discharge of said piezoelectric vibrating plate;

a third discharge period starting immediately after the end of said second discharge period, and during which said discharging circuit discharges said piezoelectric vibrating plate at a third discharge time constant smaller than said second discharge time constant.

12. The ink jet recording apparatus according to claim 11, wherein $2 \leqq n \leqq 4$.

13. The ink jet recording apparatus according to claim 12, wherein said first discharge period starts at a time which is $0.8 \cdot T$ to $1.2 \cdot T$ after the start of the charging period.

* * * * *